United States Patent [19]

Yoshida et al.

[11] Patent Number: 4,482,603

[45] Date of Patent: Nov. 13, 1984

[54] WHOLLY AROMATIC POLYAMIDE FIBER NON-WOVEN SHEET AND PROCESSES FOR PRODUCING THE SAME

[75] Inventors: Tsugushi Yoshida; Hideharu Sasaki; Toru Sawaki; Keizo Shimada, all of Iwakuni, Japan

[73] Assignee: Teijin Limited, Osaka, Japan

[21] Appl. No.: 485,634

[22] Filed: Apr. 18, 1983

[30] Foreign Application Priority Data

Apr. 19, 1982 [JP] Japan ..... 57-63948

[51] Int. Cl.[3] ..... B32B 27/00; D02G 3/00

[52] U.S. Cl. ..... 428/287; 428/296; 428/299; 428/397; 428/311.5; 428/315.5

[58] Field of Search ..... 428/364, 296, 287, 299, 428/304, 317, 397, 298; 162/146, 157.3

[56] References Cited

U.S. PATENT DOCUMENTS

| | | | |
|---|---|---|---|
| 3,094,511 | 6/1963 | Hill, Jr. et al. | 528/337 |
| 3,393,210 | 7/1968 | Speck | 528/340 X |
| 3,756,908 | 9/1973 | Gross | 162/157.3 X |
| 3,819,569 | 6/1974 | Baird | 162/157.3 X |
| 3,937,860 | 2/1976 | Gusman et al. | 428/287 X |
| 3,956,561 | 5/1976 | Anderson | 428/296 X |
| 4,113,537 | 9/1978 | Schafer et al. | 428/296 X |

*Primary Examiner*—Lorraine T. Kendell

*Attorney, Agent, or Firm*—Burgess, Ryan & Wayne

[57] ABSTRACT

A wholly aromatic polyamide fiber non-woven sheet having satisfactory density, impregnating property, heat resistance, and surface evenness, comprises mutually, randomly entangled fibers consisting essentially of a wholly aromatic polyamide having 85 molar % or more of at least one type of recurring units selected from those of the formulae (I) and (II):

(I)

and (II)

The non-woven sheet is characterized in that the wholly aromatic polyamide fibers have portions thereof having a flattened cross-sectional profile; the aromatic polyamide fibers are fuse-bonded to each other at least at portions thereof intersecting each other; and the sheet includes pores connected to each other, and having a size at the peak of pore size distribution, of 13 microns or less determined by means of a mercury porosimeter, and no voids isolated from each other, and has a porosity of from 5% to 40% and an air permeability rate of from 0.1 to 10,000 sec/100 ml.

9 Claims, 2 Drawing Figures

WHOLLY AROMATIC POLYAMIDE FIBER NON-WOVEN SHEET AND PROCESSES FOR PRODUCING THE SAME

BACKGROUND OF THE INVENTION

1. Field of the Invention

The present invention relates to a wholly aromatic polyamide fiber non-woven sheet and processes for producing the same. More particularly, the present invention relates to a wholly aromatic polyamide fiber non-woven sheet having a high density, an enhanced impregnating property, and a satisfactory surface smoothness and processes for producing the same.

2. Description of the Prior Art

Polyester, nylon, and other thermoplastic synthetic fibers bonded or entangled with each other are used for various types of non-woven sheets on the market. These thermoplastic synthetic fibers are advantageous in that they are industrially produced and, thus, are readily available and in that their thermoplasticity allows the use of conventional bonding methods, for example, thermocompression bonding, in the non-sheet production process. The same thermoplasticity, however, has a great adverse effect on the thermal properties of the non-woven sheets. That is, the resultant non-woven sheet exhibits poor heat resistance and flame retardancy and, thus, is not suitable for use as a lightweight composite material, such as building material, interior material, electrical insulating material, on honeycomb cone, which require high heat resistance and flame retardancy.

Aromatic polyamides are known materials with high heat resistance and flame retardancy. However, aromatic polyamides are generally non-thermoplastic and, thus, cannot be readily shaped into a paper-like sheet. Several techniques have been heretofore developed to utilize aromatic polyamides as a paper-like sheet, however, the products resulting from these techniques still leave much to be desired with regard to their properties.

Aromatic polyamide paper-like sheets known hitherto may be roughly classified into the following three groups:

(1) Paper-like sheets in which a portion of the aromatic polyamide fibers is in the special form of fibrids having a specific entangling property. This type of sheet is prepared by a process as typically disclosed in Japanese Examined Patent Publication (Kokoku) No. 35-11851 or U.S. Pat. No. 2,999,788 or 3,123,518.

(2) Non-woven sheets in which a thermoplastic material, for example, a polyester, is used as a binder;

(3) Non-woven sheets in which at least a part of the aromatic polyamide fibers used is not substantially crystallized and oriented and the polyamide fibers are heat-bonded under pressure at a temperature above the glass transition point of the noncrystallized and oriented polyamide fibers but below the glass transition point of the crystallized and oriented polyamide fibers, which sheet is prepared by a process as typically disclosed in Japanese Unexamined Patent Publication (Kokai) No. 51-75179.

Conventional sheets of these three groups, however, all have serious problems with regard to their properties in practical use, i.e., structural density, impregnating property, and heat resistance, and, thus, are still unsatisfactory.

Products of group (1) have a sufficiently dense structure and an excellent surface smoothness because of the use of a material having the special form of fibrids, but have a poor impregnating property. The poor impregnating property reduces the useful life of the sheet and results in unsatisfactory dielectric strength and mechanical strength when used for an insulating material essentially requiring the use of an insulating oil, an insulating varnish, and the like and a lightweight composite material and an electrical material, both of which require essentially a resin impregnation treatment. The characteristics of dense structure, smooth surface, but poor impregnating property are inherent in products in which fibrids are used. Therefore, it is considered to be very difficult to improve only the poor impregnating property of the product, while keeping its excellent denseness and surface smoothness. That is, the product is in the form of highly developed fibrids on thin film and it is considered, thus, that the fibrids have a high entangling ability to unite aromatic polyamide fibers into a sheet. Therefore, if the content is increased, the structural density and the surface smoothness of the resultant sheet are enhanced, while air bubbles are formed by the fibrids and a cover is formed over the pores penetrating through the thickness of the sheet at both surfaces thereof, resulting in voids isolated from each other in the sheet. The presence of the voids is a major cause for the poor impregnating property and unsatisfactory dielectric strength of the sheet impregnated with a resin. Decreasing the pulp content will improve the impregnating property of the resultant sheet, but, at the same time, will reduce the density and surface smoothness. As a products of group (1) on the market, there may be mentioned Nomex Type 410, intended for electrical insulating material, and Nomex Type 424, intended for an impregnating matrix, both products being manufactured by E. I. du Pont de Nemours & Co., Inc. If the porosity described hereinafter is used as a measure of the denseness and an air permeability rate (the time, in seconds, required for 100 cc of air to pass through a sheet) is used as a measure of the impregnating property, the product of Nomex Type 410 exhibits a porosity of from 20% to 42% and, thus, has a dense structure, while the air permeability rate thereof is a very high value of about $10^4$ sec/100 ml, indicating the poor impregnating property of the product.

The cross-sectional profile of this type of sheet, observed under a scanning electron microscope at a magnification of 1000 is shown in FIG. 1. It is clearly confirmed from FIG. 1 that isolated voids are present in the sheet. Therefore, this sheet is estimated to have a high pulp content. On the other hand, the Nomex Type 424 sheet is estimated to have a decreased fibrid content and to exhibit an improved impregnating property because it exhibits an air permeability rate as low as 1 to several seconds/100 ml, while the porosity thereof is as high as 65%, indicating the highly porous structure of the sheet. That is, the products of group (1) cannot essentially exhibit an adequate impregnating property while retaining a dense structure. This feature is considered to be a major cause for the fact that the product can only exhibit unsatisfactory functions when it is used for producing a lightweight composite material such as honeycomb core and an impregnation type electrical insulating material requiring resin impregnation.

Products of group (2) have the essential disadvantage that the excellent heat resistant characteristic of the aromatic polyamide is damaged because a thermoplastic material having a low heat resistance is used as the binder. As products of group (2) on the market, there may be mentioned actually manufactured heat-resistant non-woven sheets. These non-woven sheets are all considered to be aromatic polyamide non-woven sheets containing polyethylene terephthalate fibers as the binder. For the above-mentioned reason, the content of the thermoplastic material in the sheet should be controlled to the minimum level required to form the sheet. Therefore, the sheet inevitably tends to exhibit a reduced denseness. As a result of measurements on heat-resistant non-woven sheets collected from the market, the present inventors found that the porosity is in the range of from 40% to 70% and the air permeability rate is in the range of from 0.1 to several seconds/100 ml. Therefore, these non-woven sheets exhibit an excessively large air permeability. Of course, the heat resistance of these non-woven sheets is significantly lower than that of a sheet consisting of an aromatic polyamide alone. Even if a little reduction in heat resistance is tolerated, the non-woven sheets can still exhibit only unsatisfactory functions due to their highly porous structure when they are used for the production of a lightweight composite material such as a honeycomb core and an impregnation type electrical insulating material requiring resin impregnation or the like.

Products of group (3) have not generally come out on the market yet. Since the raw material consists of only fibers having substantially no plasticity, the resultant sheet usually does not have a dense structure. This is presumed from the porosity thereof of 30% to 70% described in Japanese Unexamined Patent Publication (Kokai) No. 51-75179. Measurements by the present inventors invention, showed that the porosity is in the range of from 40% to 70% and the air permeability rate is in the range of from 0.1 to several seconds/100 ml. For this reason, products of group (3) can only exhibit unsatisfactory functions due to their highly porous structure when used for the production of a lightweight composite material such as a honeycomb core and an impregnation type electrical insulating material requiring resin impregnation or the like. The present inventors made extensive studies in order to develop a quite novel sheet having satisfactory structural denseness, adequate impregnating property and high heat resistance.

SUMMARY OF THE INVENTION

An object of the present invention is to provide a wholly aromatic polyamide fiber non-woven sheet having a satisfactory dense structure, impregnating property, and heat resistance and processes for producing the same.

Another object of the present invention is to provide a wholly aromatic polyamide fiber non-woven sheet useful as a core material of lightweight composite articles and resin-impregnated electric insulating materials and processes for producing the same.

The wholly aromatic polyamide fiber non-woven sheet of the present invention comprises wholly aromatic polyamide fibers randomly entangled with each other and consisting essentially of a wholly aromatic polyamide having 85 molar % or more of at least one type of recurring units selected from those of the formulae (I) and (II):

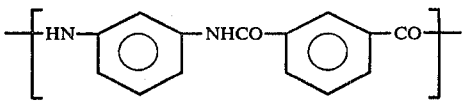

(I)

and

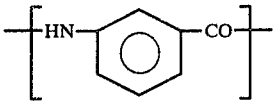

(II)

which non-woven sheet is characterized in that the wholly aromatic polyamide fibers have portions thereof having a flattened cross-sectional profile; the aromatic polyamide fibers are fuse-bonded to each other at least at portions thereof intersecting each other; and the sheet includes pores connected to each other and having a size at the peak of pore size distribution, of 13 microns or less determined by means of a mercury porosimeter, and no voids isolated from each other, and has a porosity of from 5% to 40% and an air permeability rate of from 0.1 to 10,000 sec/100 ml.

The above-mentioned wholly aromatic polyamide fiber non-woven sheet can be produced by a process comprising the steps of: providing a precursory non-woven sheet comprising wholly aromatic polyamide fibers randomly entangled with each other and consisting essentially of a wholly aromatic polyamide having 85 molar % or more of at least one type of recurring units selected from those of the formulae (I) and (II):

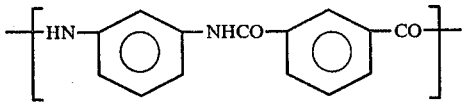

(I)

and

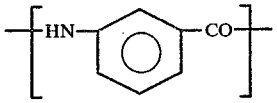

(II)

impregnating the precursory non-woven sheet with a plasticizing agent consisting of at least one member selected from the group consisting of polar amide solvents, water, and mixtures of at least one of the polar amide solvents with water, the plasticizing agent being impregnated in an amount, in terms of the polar amide solvent, of from 0.5% to 200%, preferably from 1% to 100%, based on the weight of the precursory non-woven sheet; heat-pressing the impregnated precursory non-woven sheet by means of a pair of pressing rolls at a temperature of from 200° C. to 400° C. under a pressure of from 50 to 600 kg/cm to an extent that the wholly aromatic polyamide fibers have portions thereof having a flattened cross-sectional profile, the aromatic polyamide fibers are fuse-bonded to each other at least at portions thereof intersecting each other; and the resultant sheet includes pores connected to each other and having a size at the peak of pore size distribution, of 13 microns or less determined by means of a mercury porosimeter and no voids isolated from each other, and has a porosity of from 5% to 40% and an air permeability rate of from 0.1 to 10,000 sec/100 ml.

The wholly aromatic polyamide fiber non-woven sheet can be produced by another process comprising the steps of: providing a precursory non-woven sheet comprising wholly aromatic polyamide fibers randomly entangled with each other and consisting essentially of a wholly aromatic polyamide having 85 molar % or more of at least one type of recurring units selected from those of the formulae (I) and (II):

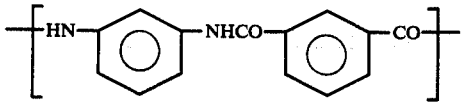

(I)

and

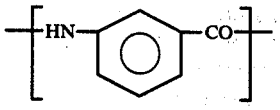

(II)

at least a portion of the wholly aromatic polyamide fibers containing a plasticizing agent consisting of at least one polar amide solvent in an amount of from 3% to 20% based on the weight of the fibers; and heat-pressing the precursory non-woven sheet by means of a pair of pressing rolls at a temperature of from 280° C. to 400° C. under a pressure from 50 to 600 kg/cm to an extent that the wholly aromatic polyamide fibers have portions thereof having a flattened cross-sectional profile, the aromatic polyamide fibers are fuse-bonded to each other at least at portions thereof intersecting each other, and the resultant sheet includes pores connected to each other having a size at the peak pore size distribution, of 13 microns or less determined by means of a mercury porosimeter, and no voids isolated from each other and has a porosity of from 5% to 40%, and an air permeability rate of from 0.1 to 10,000 sec/100 ml.

The wholly aromatic polyamide fibers preferably are a mixture of drawn, heat-treated fibers and partially drawn, non-heat-treated fibers and/or undrawn, non-heat treated fibers.

DESCRIPTION OF THE PREFERRED EMBODIMENTS

Figure 1:
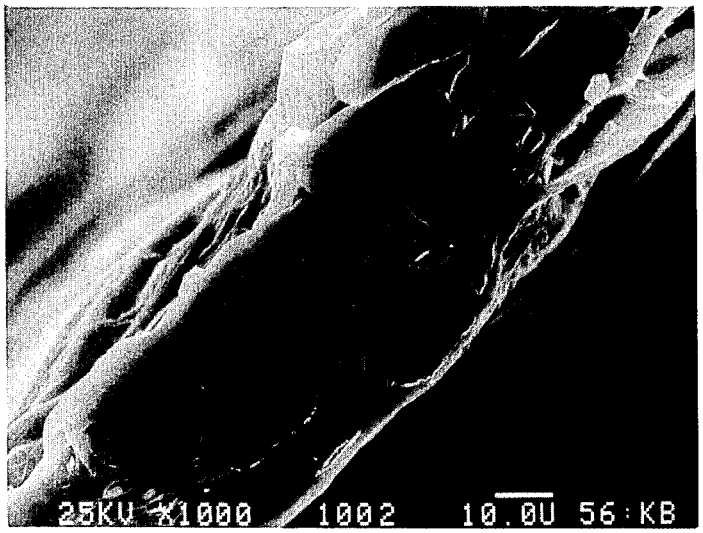
FIG. 1 is an electron microscopic cross-sectional view of a conventional non-woven sheet at a magnification of 1,000.

The non-woven sheet of the present invention comprises wholly aromatic polyamide fibers randomly entangled with each other to form a body of non-woven sheet and consisting essentially of a wholly aromatic polyamide having at least 85 molar %, preferably at least 90 molar %, of at least one type of recurring units selected from those of the fomulae (I) and (II):

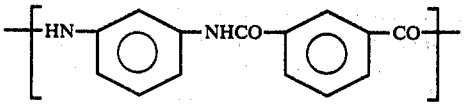

(I)

and

-continued

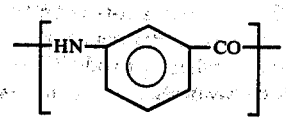

(II)

It is preferable that the wholly aromatic polyamide has 90 molar % of methaphenylene isophthalamide recurring units of the formula (I).

The wholly aromatic polyamide may contain 15 molar % or less, preferably, 10 molar % or less, of at least one type of recurring units different from those of the formulae (I) and (II). The different recurring units may contain paraphenylene radicals, biphenylene radicals, and/or the radicals of the formula (III):

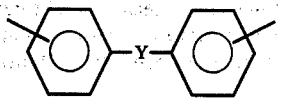

(III)

wherein Y represent a member selected from the group consisting of

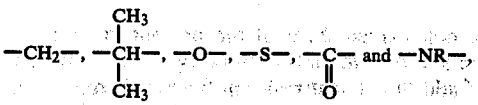

wherein R represents a hydrogen atom or an alkyl radical having 1 to 3 carbon atoms.

The aromatic polyamide fibers usable for the present invention may be produced by any known process. For example, polymethaphenylene isophthalamide fibers can be produced by a process wherein a polymethaphenylene isophthalamide resin is dissolved in a polar amide solvent, for example, N-methyl-2-pyrrolidone, the resultant spinning dope solution is subjected to a dry spinning process, a wet spinning process, or a semi-dry spinning process, the resultant undrawn filaments are washed with water, and, then, if necessary, subjected to a drawing process in boiling water, to a drying process, and to a draw-heat treating process at or above the glass transition temperature of the fibers.

In the non-woven sheet of the present invention, it is preferable that the wholly aromatic polyamide fibers are a mixture of drawn, heat-treated fibers and undrawn, non-heat-treated fibers and/or partially drawn, non-heat-treated fibers. The drawn, heat-treated fibers are prepared by partially drawing the undrawn fibers in boiling water and then by finally drawing and heat treating the drawn fibers at or above the glass transition temperature of the fibers, for example, 250° C. to 400° C. In this case, the total draw ratio is in the range of from 2.5 to 5.0. The resultant drawn, heat-treated fibers are substantially oriented and crystallized.

The undrawn, non-heat-treated fibers are collected after the spun fibers are washed with water and are not oriented and not crystallized. The partially drawn, non-heat-treated fibers are prepared by partially drawing the undrawn fibers in boiling water at a draw ratio of from 1.05 to 4.0 so as to partially orient and partially crystallize the fibers.

In the non-woven sheet of the present invention, it is preferable that the content of the sum of the undrawn, non-heat-treated fibers and the partially drawn, non-heat-treated fibers be at least 10% by weight, more preferably, in the range of from 10% to 90% weight. The proportion of the non-heat-treated fibers to the heat-treated fibers is variable depending on the conditions of the non-woven sheet production, which are controlled from the viewpoints of resource and energy conservation.

It is preferable that the drawn, heat-treated fibers and the partially drawn, non-heat-treated fibers have a denier of 5 or less and that the undrawn, non-heat treated fibers have a denier of more than 3. These features are effective for producing the non-woven sheet having the above-mentioned essential features of the present invention.

The non-woven sheet of the present invention may be composed of a core layer consisting essentially of the partially drawn, non-heat-treated fibers and/or the undrawn, non-heat-treated fibers and two surface layers each consisting of the drawn, heat-treated fibers. In this case, the core layer is preferably in an amount of from 20% to 70% based on the entire weight of the non-woven sheet.

However, in the non-woven sheet of the present invention, the drawn, heat-treated fibers and the partially drawn, non-heat-treated fibers and/or the undrawn, non-heat-treated fibers may be mixed evenly with each other.

The non-woven sheet of the present invention may contain a small amount, preferably, 30% by weight or less, of additional heat-resistant fibers different from the wholly aromatic polyamide fibers. The additional fibers may be wholly aromatic polyester fibers, carbon fibers, inorganic natural fibers, glass fibers, and/or metallic fibers.

In the wholly aromatic polyamide fiber non-woven sheet of the present invention, it is essential that mutually entangled fibers have portions thereof having a flattened cross-sectional profile and fuse-bonded to each other at least at portions thereof intersecting each other. These features are important for enhancing the dimensional stability and stiffness of the resultant non-woven sheet. Also, it is essential for the non-woven sheet of the present invention that it include pores connected to each other and to the ambient atmosphere, and having a size not exceeding 13 microns at the peak of the pre size distribution, determined by means of a mercury porosimeter. The size of the largest pores in the non-woven sheet preferably does not exceed 50 microns. Also, it is essential that the non-woven sheet include no voids isolated from each other and from the ambient atmosphere. Furthermore, it is essential that the non-woven sheet have a porosity of from 5% to 40% preferably, 10% to 35% and an air permeability rate of from 0.1 to 10,000 sec/100 ml, preferably, 1 to 5,000 sec/100 ml, more preferably, 10 to 5,000 sec/100 ml.

The above-mentioned features are important for imparting both a satisfactory structural density and an enhanced impregnating property to the non-woven sheet, without degrading the heat resistance of the sheet.

The non-woven sheet of the present invention having the above-mentioned features is new and cannot be found among conventional non-woven sheets.

The size of the pores can be measured by means of a mercury porosimeter in such a manner that mercury is allowed to penetrate into a non-woven sheet specimen having a weight of 0.1 to 0.5 g under a pressure of from 50 micron Hg Abs. to 25000 psi Abs.

The non-woven sheet of the present invention allows mercury to penetrate thereinto in an amount of from 0.1 to 0.5 ml/g, preferably, from 0.1 to 0.45 ml/g, and includes pores having a size not exceeding 13 microns at the peak of the pore size distribution and a largest size not exceeding 50 microns and connected to each other.

The porosity is a measure of structural density of the non-woven sheets and is determined in accordance with the following equation:

$$\text{Porosity (\%)} = \frac{(1.37 - \text{Density of sheet})}{1.37} \times 100$$

wherein the density of sheet is determined by providing a specimen of the sheet having a predetermined area, by measuring the weight of the specimen by means of a chemical balance at an accuracy of 0.1 mg or less, and by measuring the thickness of the specimen by means of a thickness meter, at an accuracy of 0.1 micron.

The air permeability of the non-woven sheet is determined in accordance with Japanese Industrial Standard (JIS) P 8117.

If the isolated voids are formed, the resultant non-woven sheet exhibits a degraded impregnating property. Also, if the size of the pores at the peak of the pore size distribution is larger than 13 micron and the size of largest pores is larger than 50 microns, the resultant non-woven sheet exhibits an unsatisfactory structural density. In both the above-mentioned cases, when the resultant non-woven sheet is impregnated with an electric insulating resin, the resultant product exhibits an unsatisfactory poor dielectric strength (breakdown strength) unless the amount of the impregnated insulating resin is extremely large.

If the porosity is less than 5% and/or the air permeability rate is less than 0.1 sec/100 ml, the resultant non-woven sheet exhibits an excessively large impregnating property. Also, if the porosity is more than 40% and/or the air permeability rate is more than 10,000 sec/100 ml, the resultant non-woven sheet exhibits an unsatisfactory structural density, and therefore, poor mechanical strength.

Usually, the non-woven sheet of the present invention has a weight of from 25 to 1000 g/m$^2$, a thickness of from 1 to 20 mm, a tensile strength of from 1 to 40 g/cm, a tear strength of 200 to 1000 kg, and an ultimate elongation of from 0.5% to 10%.

It is preferable that the non-woven sheet of the present invention exhibit a surface roughness, in terms of center line average roughness (Ra), of 5 microns or less, more preferably, 4 microns or less, determined in accordance with JIS B 0601-1976, by using a surface roughness measuring apparatus having a contacting needle having a diameter of 2 microns at a contacting force of the needle of 70 mg.

In the measurement of the center line average roughness Ra, a surface roughness curve is prepared by the surface roughness measuring apparatus. A portion of the curve having a length L in the direction of the center line of the curve is withdrawn from the curve. The portion L of the curve is drawn in a rectangular coordinate wherein the X-axis is parallel to the center line of the curve and the roughness Y of the curve is represented by $Y=f(X)$. The center line average roughness Ra is calculated in accordance with the following equation:

$$Ra\ (\text{micron}) = \frac{1}{L} \int_0^L |f(X)|\,dx$$

In the non-woven sheet of the present invention, the roughness Ra is usually 5 microns or less while the roughness of conventional non-woven sheet is at the smallest 6 to 7 microns. That is, the non-woven sheeet of the present invention has an excellent surface evenness.

Figure 2:
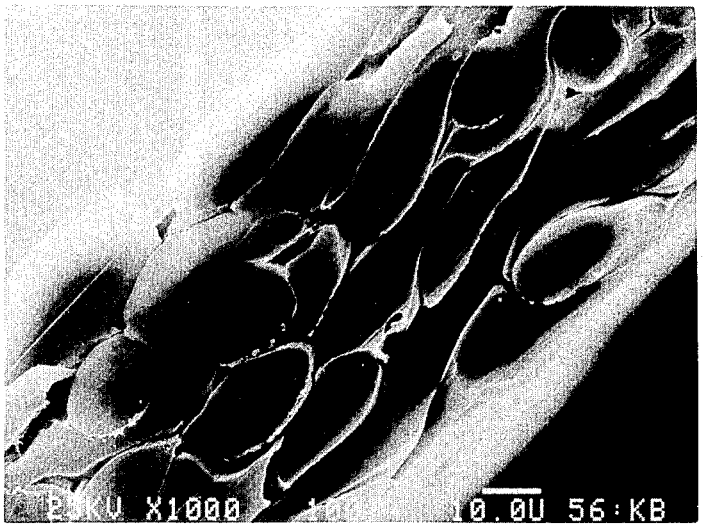
FIG. 2 is an electron microscopic cross-sectional view of a non-woven sheet of the present invention at a magnification of 1,000.

FIG. 2 shows an electron microscopic view of a cross-sectional profile of a non-woven sheet of the present invention at a magnification of 1,000. FIG. 2 shows that the non-woven sheet has a very dense structure and includes thin pores connected to each other and to the ambient atmosphere and distributed throughout the sheet. Also, FIG. 2 shows that the non-woven sheet has a very even surface and contains no voids isolated from each other and from the ambient atmosphere. Due to this specific structure, the non-woven sheet of the present invention exhibits both satisfactory density and an excellent impregnating property and, additionally, an excellent heat resistance because the non-woven sheet contains no thermoplastic substance having a poor heat resistance. This feature of the non-woven sheet of the present invention is unusual because usually the larger the structural density, the smaller the impregnating property of the sheet.

The non-woven sheet of the present invention can be produced by a process comprising the steps of providing a precursory non-woven sheet by randomly intersecting and entangling wholly aromatic polyamide fibers with each other, the aromatic polyamide fibers consisting essentially of a wholly aromatic polyamide having 85 molar % or more of at least one type of recurring units selected from those of the formulae (I) and (II); impregnating the precursory non-woven sheet with a plasticizing agent consisting of at least one member selected from the group consisting of polar amide solvents, water and mixture of at least one of the polar amide solvents with water, the plasticizing agent being impregnated in an amount, in terms of the polar amide solvent, of from 0.5% to 200% based on the weight of the precursory non-woven sheet; and heat-pressing the impregnated precursory non-woven sheet by means of a pair of pressing rolls at a temperature of from 200° C. to 400° C. under a pressure of from 50 to 600 kg/cm to an extent that the wholly aromatic polyamide fibers have portions thereof having a flattened cross-sectional profile, the aromatic polyamide fibers intersecting each other are fuse-bonded to each other at least at the intersecting portions thereof; and the resultant sheet includes pores connected to each other and having a size at the peak of the pore size distribution, of 13 microns or less determined by means of a mercury porosimeter and no voids isolated from each other and has a porosity of from 5% to 40% and an air permeability rate of from 0.1 to 10,000 sec/100 ml.

The precursory non-woven sheet can be prepared by any conventional non-woven sheet-forming method. For example, the precursory non-woven sheet can be produced from a fibrous web which can be provided by randomly opening and then accumulating aromatic polyamide staple fibers which have been crimped, by means of a flat carding machine or roller carding machine. In another method, a tow of the aromatic polyamide filaments is accumulated in the form of a stack, and then the filament stack is opened laterally by using a pair of belts in the shape of an unfolded fan and having a number of needles planted therein to form a random web. In still another method, the aromatic polyamide filaments are accumulated randomly on a belt to form a web. In the other method, aromatic polyamide staple fibers having a length of 5 to 20 mm are dispersed and, then, collected on a net surface by means of streams of air or water blown toward the staple fibers, to form a random web.

The web prepared by the above-mentioned method is subjected to a process in which the fibers or filaments are entangled with each other by means of a number of needles or streams of water or air to form a precursory non-woven sheet.

The precursory non-woven sheet is impregnated with a plasticizing agent for the aromatic polyamide fibers. The plasticizing agent consists of at least one member selected from the group consisting of polar amide solvents, for example, N-methyl-2-pyrrolidone, N,N-dimethylformamide, N,N-dimethylacetamide, dimethylsulfoxide, hexamethylphosphoramide, tetramethyl urea, N-methyl caprolactun, and N-methyl pyperidine; water; and mixtures of at least one of the above-mentioned polar amide compounds with water. In the case where the plasticizing agent contains the polar amide solvent, it is preferable that the amount of the plasticizing agent, in terms of the polar amide solvent, applied to the precursory non-woven sheet be in the range of from 0.5% to 200%, preferably 1% to 100%, based on the weight of the precursory non-woven sheet. In the case where the plasticizing agent consists of a mixture of the polar amide solvent and water, the proportion of the polar amide solvent is preferably 1% or more, more preferably in the range of from 3% to 15% based on the weight of the mixture.

If the amount of the polar amide solvent applied to the precursory non-woven sheet is less than 0.5% by weight, the resultant non-woven sheet sometimes may exhibit unsatisfactory mechanical properties, surface evenness, and density. The mechanical properties, surface evenness, and density of the non-woven sheet increase with an increase in the amount of the applied polar amide solvent. However, the increase in the above-mentioned properties reaches its maximum at a 200% by weight amount of the applied polar amide solvent. An increase in the amount of the applied polar amide solvent to more than 200% by weight does not further enhance the above-mentioned properties. Also, an excessively large amount of the polar amide solvent sometimes causes ineffective consumption of the polar amide solvent and energy loss in the heat-pressing procedure.

In the case where the plasticizing agent consists of water, the plasticizing agent is applied preferably in an amount of 10% to 250% based on the weight of the precursory non-woven sheet. If the amount of the applied water is less than 10% by weight, the resultant non-woven sheet has unsatisfactory mechanical properties and surface evenness. If the amount of the applied water is more than 250% by weight, it results in a large consumption of energy in the heat-pressing procedure.

The application of the plasticizing agent to the precursory non-woven sheet is not limited to a specific method so long as the plasticizing agent is able to be impregnated evenly in the precursory non-woven sheet. For example, the plasticizing agent can be applied by spraying it to the precursory non-woven sheet or by immersing the precursory non-woven sheet in the plasticizing agent.

The heat-pressing procedure for the plasticizing agent-impregnating precursory non-woven sheet is carried out by means of a pair of pressing rolls at a temperature of 200° C. to 400° C. under a pressure of from 50 to 600 kg/cm. This heat-pressing procedure is carried out to an extent that at least a portion of the wholly aromatic polyamide fibers is flattened and the fibers are fuse-bonded to each other at least at portions thereof intersecting each other and that the resultant sheet includes pores connected to each other and, therefore, to the ambient atmosphere, having a size at the peak of the pore size distribution, not exceeding 13 microns determined by means of a mercury porosimeter and having no voids isolated from each other and, therefore, from the ambient atmosphere and has a porosity of from 5% to 40% and an air permeability rate of from 0.1 to 10,000 sec/100 ml.

When the heat-pressing temperature is less than 200° C. and/or the heat-pressing pressure is less than 50 kg/cm, the fibers cannot be satisfactorily fuse-bonded to each other. Also, when the heat-pressing temperature is more than 400° C. and/or the heat-pressing pressure is more than 600 kg/cm, it becomes difficult to obtain a uniform non-woven sheet.

In another process for producing the wholly aromatic polyamide fiber non-woven sheet of the present invention, (1) a precursory non-woven sheet is provided by randomly entangling wholly aromatic polyamide fibers with each other, the aromatic polyamide fibers consisting essentially of a wholly aromatic polyamide having 85 molar % or more of at least one type of recurring units selected from those of the formulae (I) and (II) and at least a portion of the aromatic polyamide fibers containing a plasticizing agent consisting of at least one polar amide solvent as mentioned hereinbefore, in an amount of from 3% to 20% based on the weight of the fibers. Due to the presence of the plasticizing agent, the aromatic polyamide fibers exhibit a satisfactory thermoplasticity.

Thereafter, the precursory non-woven sheet is heat-pressed by means of a pair of pressing rolls at a temperature of from 300° C. to 400° C. under a pressure of 50 to 600 kg/cm to the same extent as that described above.

In this process, if the heat-pressing temperature is less than 300° C. and/or the heat-pressing pressure is less than 50 kg/cm, the fibers are not fuse-bonded to each other. Also, if the heat-pressing temperature is more than 400° C. and/or the heat-pressing pressure is above 600 kg/cm, the resultant non-woven sheet is uneven in quality.

In the preparation of the wholly aromatic polyamide fiber non-woven sheet of the present invention, it is essential that the precursory non-woven sheet be heat-pressed by means of a pair of pressing rolls at a specific temperature under a specific pressure in the presence of a plasticizing agent applied to or contained in the precursory non-woven sheet.

As is apparent from the foregoing description, the present invention makes it possible to provide a quite novel non-woven sheet having a combination of high structural density, adequate impregnating property, excellent heat resistance, and excellent surface evenness, which could never be obtained by the prior arts.

That is, the high density of the non-woven sheet of the present invention is effective for preventing an adhesive from oozing excessively, for example, in the production of a honeycomb core, and for causing, in cooperation with the excellent impregnating property, a resin impregnated electrical insulating material comprising the non-woven sheet to exhibit excellent electrical properties. Also, the excellent impregnating property of the non-woven sheet of the present invention is effective for preventing impregnation failure and for enhancing the life of instruments and for simplifying the impregnating procedure. In addition, the excellent surface evenness of the non-woven sheet of the present invention significantly contributes to the imparting of excellent functions to a laminate product or an industrial release paper when the non-woven sheet is used as a laminate substrate.

Moreover, since the non-woven sheet of the present invention is comprised essentially of aromatic polyamide fibers, it exhibits a higher Elemendorf tear strength than that of a sheet comprising fibrids, for example, Nomex 410 sheet. In addition, the non-woven sheet of the present invention exhibits a much better long-term heat resistance, as compared with the above-mentioned conventional products of groups (1), (2), and (3), although the cause for this is unclear.

Several examples are given hereunder for the purpose of illustrating the present invention more clearly. However, the present invention is not limited to these examples.

In the examples, the intrinsic viscosity of the polymer was determined in a concentration of 0.5 g per 1 dl of concentrated sulfuric acid at a temperature of 30° C.

The oil-absorbing property of the resultant sheet was determined in the following manner.

A specimen 5 cm square was dried in vacuo and, then, was placed on the surface of an insulating oil No. 1 (JIS) at a temperature of 25° C. under atmospheric pressure. The time required for the insulating oil to emerge on the surface of the specimen was determined.

The air permeability rate was determined in accordance with the method of JIS P 8117 by using a B type apparatus.

EXAMPLES 1 THROUGH 7 AND COMPARATIVE EXAMPLES 1 AND 2

The following three types of aromatic polyamide fibers were prepared.

A dope solution of 21% by weight of a poly-m-phenylene isophthalamide having an intrinsic viscosity of 1.8 and dissolved in N-methyl-2-pyrrolidone was subjected to a wet spinning procedure. That is, extruded filamentary streams of the dope solution were coagulated in a coagulating bath containing 43% by weight of calcium chloride at a temperature of 95° C. After water washing and drying, the dried filaments were subjected to a crimping procedure. The crimped filaments were cut into a length of 51 mm. Thus, staple fibers having a denier of 1.5 and a length of 51 mm were obtained. The resultant undrawn, non-heat-treated staple fibers are referred to as fibers M hereinafter.

The same dope solution as mentioned above was extruded and the resultant filamentary streams of the dope solution were introduced into the same coagulating bath as that mentioned above. After water washing, the resultant undrawn filaments were partially drawn in a boiling water bath at a draw ratio of 2.7. After drying, the partially drawn filaments were subjected to a crimping procedure. The crimped filaments were cut into a length of 51 mm. Thus, staple fibers having a denier of 1.5 and a length of 51 mm were obtained. The resultant partially drawn, non-heat-treated staple fibers are referred to as fibers F hereinafter.

The same dope solution as mentioned above was extruded and the extruded filamentary streams were introduced into the same coagulating bath as mentioned above. After water washing, the undrawn filaments were partially drawn in a boiling water bath at a draw ratio of 2.7. After drying, the partially drawn filaments were further drawn on a hot plate at a draw ratio of 1.3 at a temperature of 350° C. The hot-drawn filaments were subjected to a crimping procedure. The crimped filaments were cut into a length of 51 mm. Thus, staple fibers having a denier of 1.5 and a length of 51 mm were obtained. The resultant drawn, heat-treated staple fibers are referred to as fibers R hereinafter.

In each of Examples 1 to 7 the above-mentioned types of staple fibers were blended with each other in the proportion indicated in Table 1. After the fiber blend was pre-opened by using a single scutcher, the pre-opened fibers were subjected two times to flat carding. Then the carded fibers were laid on a belt conveyor by using a cross-laid webber so as to form a web. Subsequently, the web was subjected to a needling procedure by means of a needling machine having needles having 9 barbs at a needle density of 84 needles/cm$^2$, so as to provide a precursory non-woven sheet having a weight of 80 g/m$^2$ in which the fibers were entangled with each other. Then, a 3 wt % aqueous solution of N-methyl-2-pyrrolidone was applied to both surfaces of the precursory non-woven sheet by using a spray apparatus. The amount of the aqueous solution picked up by the precursory non-woven sheet was 100% by weight based on the weight of the precursory non-woven sheet. Thereafter, the aqueous solution-containing precursory non-woven sheet was subjected to a heat-pressing procedure by using a pair of heat-press rolls under the conditions of a temperature of 280° C., a linear pressure of 400 kg/cm, and a speed of 8 m/min and was taken up from the heat-press rolls under tension, in a continuous manner.

The physical properties of the resultant non-woven sheet are indicated in Table 1.

The tensile strength and the ultimate elongation were determined by using an Instron testing machine under the conditions of a chuck distance of 20 cm, a sample width of 1.5 cm, and a head speed of 10 cm/min.

In Comparative Example 1, a precursory non-woven sheet having a fiber blend ratio of R/F of 4/6 and a weight of 80 g/m$^2$ was prepared according to the same procedures as mentioned above. Without applying the plasticizer to the precursory non-woven sheet, the precursory sheet was subjected to a heat pressing procedure under the conditions of a temperature of 350° C., a linear pressure of 400 kg/cm, and a speed of 8 m/min, and was taken up from the rolls under tension in a continuous manner. The physical properties of the resultant non-woven sheet are indicated in Table 1.

Also, in Comparative Example 2 a precursory non-woven sheet having a fiber blend ratio of R/M of 4/6 and a weight of 80 g/m$^2$ was prepared according to the same procedures as mentioned above. Without applying the plasticizer to the sheet, the sheet was subjected to a heat-pressing procedure under the conditions of a temperature of 350° C., a linear pressure of 400 kg/cm, and a speed of 8 m/min and was taken up from the rolls under tension in a continuous manner. The physical properties of the resultant non-woven sheet are indicated in Table 1.

TABLE 1

| | | Non-woven sheet | | | | | | | |
|---|---|---|---|---|---|---|---|---|---|
| Example No. | Fiber blend ratio | Thickness (μm) | Porosity (%) | Tensile strength (kg/15 mm) | Ultimate elongation (%) | Ra (μm) | Air permeability rate (sec/100 ml) | Amount of penetrated mercury (ml/g) | Size of pores at peak of pore size distribution (μm) |
| Example 1 | R/M = 8/2 | 105 | 35 | 4.3 | 3.2 | 2.3 | 21 | 0.38 | 13 |
| Example 2 | = 4/6 | 67 | 16 | 5.8 | 4.1 | 1.4 | 68 | 0.18 | 12 |
| Example 3 | = 0/10 | 60 | 10 | 6.1 | 3.8 | 1.1 | 148 | 0.10 | 13 |
| Example 4 | R/F = 8/2 | 97 | 36 | 3.9 | 3.6 | 2.0 | 19 | 0.33 | 13 |
| Example 5 | = 4/6 | 63 | 17 | 5.9 | 4.3 | 1.5 | 56 | 0.26 | 13 |
| Example 6 | = 0/10 | 58 | 12 | 6.4 | 6.1 | 1.2 | 123 | 0.12 | 12 |
| Example 7 | = 10/0 | 100 | 37 | 3.5 | 2.2 | 4.2 | 10 | 0.45 | 13 |
| Comparative Example 1 | R/F = 4/6 | 115 | 38 | 6.0 | 4.0 | 6.7 | 2 | 2.01 | >28 |
| Comparative Example 2 | R/M = 4/6 | 109 | 36 | 6.1 | 4.0 | 6.2 | 3 | 1.82 | >28 |

EXAMPLES 8 THROUGH 10 AND COMPARATIVE EXAMPLE 3

In each of Examples 8 to 10 and Comparative Example 3, a precursory non-woven sheet having a fiber blend ratio of R/F of 4/6 and a weight of 80 g/m$^2$, which was prepared in accordance with the same procedures as those described in example 5, was sprayed with a 5 wt % aqueous solution of N-methyl-2-pyrrolidone in an amount such as to provide the pickup (in terms of aqueous solution) indicated in Table 2. After the spraying procedure, the precursory sheet was continuously heat-pressed by means of a pair of pressing rolls under the conditions of a temperature of 225° C., a linear pressure of 400 kg/cm, and a speed of 10 m/min and was taken up from the rolls under a tension such as to generate no wrinkles in the resultant sheet. The physical properties of the resultant non-woven sheet are indicated in Table 2.

TABLE 2

| Example No. | Pick up of plasticizing agent (wt %) | Non-woven sheet: Thickness (μm) | Porosity (%) | Tensile strength (kg/15 mm) | Ultimate elongation (%) | Ra (μm) | Air permeability rate (sec/100 ml) | Oil-absorbing property (sec) | Amount of penetrated mercury (ml/g) | Size of pores at peak of pore size distribution (μm) |
|---|---|---|---|---|---|---|---|---|---|---|
| Comparative Example 3 | 5 | 141 | 51 | 1.7 | 1 | 5.2 | 1 | <0.5 | 2.23 | <28 |
| Example 8 | 20 | 78 | 37 | 4.1 | 2.3 | 4.0 | 14 | 0.5 | 0.44 | 13 |
| Example 9 | 120 | 60 | 16 | 6.9 | 4.5 | 1.3 | 28 | 2.0 | 0.30 | 13 |
| Example 10 | 200 | 62 | 14 | 7.1 | 4.6 | 1.3 | 30 | 2.2 | 0.28 | 13 |

EXAMPLES 11 THROUGH 14 AND COMPARATIVE EXAMPLE 4

In each of Examples 11 through 14 and Comparative Example 4, a precursory non-woven sheet having a fiber blend ratio of R/F of 4/6 and a weight of 80 g/m$^2$, which was prepared in accordance with the same procedures as those described in example 5, was sprayed with a 3 wt % aqueous solution of N-methyl-2-pyrrolidone in an amount such as to provide a pickup of 100% by weight. After the spraying procedure, the precursory sheet was continuously heat-pressed by means of a pair of press rolls under the conditions of the temperature indicated in Table 3, a linear pressure of 400 kg/cm, and a speed of 10 m/min and taken up from the rolls under a tension such as to generate no wrinkles in the resultant sheet. The physical properties of the resultant non-woven sheet are indicated in Table 3.

TABLE 3

| Example No. | Pressing temperature °C. | Non-woven sheet: Thickness (μm) | Porosity (%) | Tensile strength (kg/15 mm) | Ultimate elongation (%) | Ra (μm) | Gas permeability rate (sec/100 ml) | Oil-absorbing property (sec) | Amount of penetrated mercury (ml/g) | Size of pores at peak of pore size distribution (μm) |
|---|---|---|---|---|---|---|---|---|---|---|
| Comparative Example 4 | 100 | 137 | 54 | 0.9 | 1 | 4.7 | 3 | <0.5 | 2.21 | >28 |
| Example 11 | 150 | 90 | 26 | 2.5 | 2.1 | 2.3 | 12 | 1.2 | 0.40 | 13 |
| Example 12 | 200 | 76 | 18 | 5.1 | 3.8 | 1.7 | 28 | 1.7 | 0.29 | 13 |
| Example 13 | 250 | 61 | 16 | 6.3 | 4.2 | 1.5 | 50 | 1.8 | 0.20 | 13 |
| Example 14 | 300 | 60 | 15 | 7.2 | 4.9 | 1.5 | 72 | 2.1 | 0.16 | 12 |

EXAMPLES 15 THROUGH 17

In each of Examples 15 through 17, a precursory non-woven sheet consisting of fibers R alone and a weight of 80 g/m$^2$, which was prepared according to the same procedures as those described in example 7, was sprayed with a 3 wt % aqueous solution of N-methyl-2-pyrrolidone in an amount such as to provide a pickup of 100% by weight. After the spraying procedure, the precursory sheet was continuously heat-pressed by means of a pair of press rolls under the conditions of the temperature indicated in Table 4, a linear pressure of 400 kg/cm, and a speed of 8 m/min and taken up from the rolls under a tension such as to generate no wrinkles in the resultant sheet. The physical properties of the resultant non-woven sheet are indicated in Table 4.

TABLE 4

| Example No. | Pressing temperature (°C.) | Non-woven sheet: Thickness (μm) | Porosity (%) | Tensile strength (kg/15 mm) | Ultimate elongation (%) | Ra (μm) | Air permeability rate (sec/100 ml) | Oil-absorbing property (sec) | Amount of penetrated mercury (ml/gl) | Size of pores at peak of pore size distribution (μ) |
|---|---|---|---|---|---|---|---|---|---|---|
| Example 15 | 250 | 114 | 39 | 3.3 | 2.0 | 4.8 | 10 | 1.0 | 0.48 | 13 |
| Example 16 | 280 | 100 | 37 | 3.5 | 2.2 | 4.2 | 13 | 1.2 | 0.45 | 13 |
| Example 17 | 320 | 80 | 25 | 5.0 | 2.3 | 2.4 | 18 | 1.9 | 0.37 | 13 |

EXAMPLES 18 AND 19 AND COMPARATIVE EXAMPLE 5

In each of Examples 18 and 19 and Comparative Example 5, a precursory non-woven sheet having a fiber blend ratio of R/F of 4/6 and a weight of 80 g/m$^2$, which was prepared according to the same procedures as those described in Example 5, was sprayed with a 3 wt % aqueous solution of N-methyl-2-pyrrolidone in an amount such as to provide a pickup of 100% by weight. After the spraying procedure, the precursory sheet was continuously heat-pressed by means of a pair of press rolls under the conditions of a temperature of 280° C., a linear pressure of 400 kg/cm, and the speed indicated in Table 5. The physical properties of the resultant non-woven sheet are indicated in Table 5.

TABLE 5

| | Heat-pressing speed (m/sec) | Non-woven sheet | | | | | | | | |
|---|---|---|---|---|---|---|---|---|---|---|
| | | Thickness (μm) | Porosity (%) | Tensile strength (kg/15 mm) | Ultimate elongation (%) | Ra (μm) | Air permeability rate (sec/100 ml) | Oil-absorbing property (sec) | Amount of penetrated mercury (ml/g) | Size of pores at peak of pore size distribution (μm) |
| Comparative Example 5 | 1 | 102 | 28 | 1.3 | 1.1 | 4.4 | 15 | <0.5 | 0.82 | 20 |
| Example 18 | 5 | 68 | 16 | 5.3 | 3.6 | 1.7 | 52 | 1.2 | 0.23 | 12 |
| Example 19 | 10 | 70 | 15 | 6.4 | 4.8 | 1.5 | 57 | 1.5 | 0.22 | 12 |

EXAMPLES 20 THROUGH 23 AND COMPARATIVE EXAMPLE 6

In each of Examples 20 through 23, a precursory non-woven sheet having a fiber blend ratio of R/F of 4/6 and a weight of 90 g/m$^2$, which was prepared in accordance with the same procedures as those described in Example 5, was impregnated with the type of solvent indicated in Table 6 in an amount such as to provide a pickup of 100% by weight. After the impregnating procedure, the precursory sheet was subjected to a heat pressing procedure by means of a pair of press rolls under the conditions of a temperature of 250° C., a linear pressure of 400 kg/cm, and a speed of 8 m/min and was taken up from the rolls under tension.

The physical properties of the resultant non-woven sheet are indicated in Table 6.

In Comparative Example 6, a non-woven sheet was prepared in accordance with the same procedures as those described above except that no plasticizing agent was applied thereto. The physical properties of this non-woven sheet are also indicated in Table 6.

EXAMPLE 24 AND COMPARATIVE EXAMPLES 7 THROUGH 10

In Example 24, the same non-woven sheet as that obtained in Example 5 except that its weight was 60 g/m$^2$ was immersed in a 20% solution of a phenolic resin in methylethylketone and impregnated with 80% by weight of the phenolic resin. The impregnated sheet was subjected to a curing procedure at a temperature of 120° C. for 120 minutes. The dielectric breakdown voltage (B.D.V) of the resultant resin-impregnated sheet is shown in Table 7.

The same impregnating procedures as described above were applied to the same non-woven sheet as that obtained in Comparative Example 1 (Comparative Example 7), to a Nomex Type 410 sheet (Comparative Example 8), to a Nomex Type 424 sheet (Comparative Example 9), and to a H8008CT sheet (a trademark of a non-woven sheet made by Japan Vilene Co.) (Comparative Example 10). The dielecteic breakdown voltages of these comparative sheets are shown in Table 7.

TABLE 6

| Example No. | Type of plasticizing agent | Non-woven sheet | | | | | | | | |
|---|---|---|---|---|---|---|---|---|---|---|
| | | Thickness (μm) | Porosity (%) | Tensile stength (kg/15 mm) | Ultimate elongation (%) | Ra (μm) | Gas permeability rate (sec/100 ml) | Oil-absorbing property (sec) | Amount of penetrated mercury (ml/g) | Size of pores at peak of pore size distribution (μm) |
| Example 20 | Water | 72 | 15 | 4.1 | 3.8 | 2.1 | 10 | 1.0 | 0.39 | 13 |
| 21 | 3 wt % aqueous solution of dimethyl acetamide | 67 | 14 | 5.6 | 4.3 | 1.5 | 28 | 1.7 | 0.29 | 13 |
| 22 | 3 wt % aqueous solution of dimethyl formamide | 65 | 14 | 5.9 | 4.4 | 1.7 | 33 | 1.4 | 0.28 | 13 |
| 23 | 3 wt % aqueous solution of dimethyl sulfoxide | 66 | 14 | 5.3 | 4.7 | 1.5 | 32 | 1.9 | 0.28 | 13 |
| comparative Example 6 | None | 142 | 70 | 1.2 | 1.0 | 7.5 | 1 | <0.5 | 2.43 | >28 |

TABLE 7

| Example No. | Non-woven sheet | | | | | | | Resin-impregnated non-woven sheet | | | |
|---|---|---|---|---|---|---|---|---|---|---|---|
| | Thickness (μm) | Porosity (%) | Air permeability (sec/100 ml) | Amount of penetrated mercury (ml/g) | Size of pores at peak of pore size distribution (μm) | B.D.V (KV) | B.D.V (KV/mm) | Thickness (μm) | Pickup of resin (%) | B.D.V (KV) | B.D.V (KV/mm) |
| Example 24 | 43 | 13 | 37 | 0.30 | 13 | 0.3 | 7 | 52 | 36 | 3.3 | 63 |
| Comparative Example 7 | 115 | 38 | 2 | 2.01 | 28 | 0.7 | 6 | 181 | 60 | 1.1 | 6 |
| Comparative Example 8 | 48 | 42 | 10 | 0.68 | 13 | 1.0 | 21 | 53 | 43 | 1.5 | 28 |
| Comparative Example 9 | 77 | 65 | 2 | 1.51 | 10 | 0.8 | 10 | 101 | 72 | 1.1 | 11 |
| Comparative Example 10 | 77 | 48 | 1 | 0.90 | 18 | 0.6 | 8 | 110 | 65 | 1.3 | 12 |

EXAMPLES 25 THROUGH 27 AND COMPARATIVE EXAMPLE 11

In Examples 25 through 27, a precursory non-woven sheet consisting of fibers R above and a weight of 230 g/m$^2$, which was prepared in accordance with the same procedures as those described in Example 7, was impregnated with N-methyl-2-pyrrolidone in an amount such as to provide the pickup indicated in Table 8. After the impregnating procedure, the precursory sheet was subjected to a heat-pressing procedure by means of a pair of press rolls under conditions of a temperature of 250° C., a linear pressure of 200 kg/cm, and a speed of 8 m/min and was taken up from the rolls under tension in a continuous manner. The physical properties of the resultant non-woven sheet are indicated in Table 8.

In Comparative Example 11, the same procedures as those described above were carried out except that no impregnating procedure was applied thereto. The physical properties of the resultant sheet are indicated in Table 8. T

TABLE 8

| Example No. | Pickup (%) | Non-woven sheet: Thickness (μm) | Porosity (%) | Tensile strength (kg/15 mm) | Ultimate elongation (%) | Ra (μm) | Air permeability rate (sec/100 ml) | Oil-absorbing property (sec) | Amount of penetrated mercury (ml/g) | Size of pores at peak of pore size distribution (μm) |
|---|---|---|---|---|---|---|---|---|---|---|
| Comparative Example 11 | 0 | 630 | 75 | 7.9 | 85 | 11.0 | <1.0 | <0.5 | 2.41 | >28 |
| Example 25 | 30 | 341 | 36 | 17.0 | 81 | 3.8 | 48 | 2.3 | 0.41 | 13 |
| 26 | 50 | 330 | 31 | 17.2 | 80 | 3.2 | 119 | 2.5 | 0.19 | 13 |
| 27 | 70 | 296 | 27 | 18.1 | 75 | 2.8 | 207 | 2.9 | 0.13 | 13 |

EXAMPLES 28 AND 29

A needled web (A) consisting of the fibers R alone and having a weight of 40 g/m$^2$ was prepared in the same manner as described in Example 7. Another needled web (B) consisting of the fibers M alone and having a weight of 40 g/m$^2$ was prepared in the same manner as described in Example 3. Still another needled web (C) consisting of a blend 4 parts by weight of the fibers R and 6 parts by weight of the fibers F and having a weight of 40 g/m$^2$ was produced in the same manner as described in Example 5.

In Example 28, a precursory non-woven laminate sheet composed of a core layer consisting of the web (B) and upper and lower layers each consisting of the web (A) and having a weight of 120 g/m$^2$ was prepared.

In Example 29, a precursory non-woven laminate sheet composed of a core layer consisting of the web (B) and upper and lower layers each consisting of the web (C) and having a weight of 120 g/m$^2$ was prepared.

In each of Examples 28 and 29, the precursory non-woven laminate sheet was sprayed with an aqueous solution of 3% by weight of N-methyl-2-pyrrolidone in an amount of 100% based on the weight of the sheet, was heat-pressed by means of a pair of heat-press rolls under the conditions of a temperature of 280° C., a linear pressure of 400 kg/cm and a speed of 8 m/min, and was taken up from the heat-press rolls under tension, in a continuous manner.

The physical properties of the resultant non-woven sheets are indicated in Table 9.

TABLE 9

| Example No. | Structure of laminate | Non-woven sheet: Thickness (μm) | Porosity (%) | Tensile strength (kg/15 mm) | Ultimate elongation (%) | Ra (μm) | Air permeability rate (sec/100 ml) | Amount of penetrated mercury (ml/g) | Size of pores at peak of pore size distribution (μm) |
|---|---|---|---|---|---|---|---|---|---|
| 28 | A/B/A | 122 | 31 | 7.7 | 5.7 | 3.0 | 13 | 0.32 | 13 |
| 29 | C/B/C | 114 | 17 | 5.6 | 1.6 | 1.5 | 3720 | 0.11 | 12 |

We claim:

1. A wholly aromatic polyamide fiber non-woven sheet consisting essentially of wholly aromatic polyamide fibers randomly entangled with each other and consisting essentially of a wholly aromatic polyamide having 85 molar % or more of at least one type of recurring unit selected from those of the formulae (I) and (II):

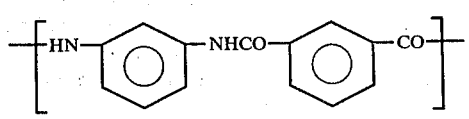

(I)

and

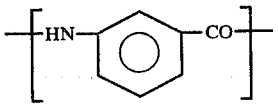

(II)

which non-woven sheet is characterized in that said wholly aromatic polyamide fibers include (A) drawn, heat-treated fibers and (B) at least one type of fibers selected from the group consisting of undrawn, non-heat-treated fibers and partially drawn, non-heat-treated fibers, and have portions thereof having a flattened cross-sectional profile; said aromatic polyamide fibers are fuse-bonded to each other at least at portions thereof intersecting each other; and said sheet includes pores connected to each other and having a size at the peak of pore size distribution, of not larger than 13 microns determined by means of a mercury porosimeter, and no voids isolated from each other, and has a porosity of from 5% to 40% and an air permeability rate of from 0.1 to 10,000 sec/100 ml.

2. The non-woven sheet as claimed in claim 1, wherein said wholly aromatic polyamide has 90 molar % of the recurring units of the formula (I).

3. The non-woven sheet as claimed in claim 1 wherein said drawn, heat-treated fibers and partially drawn, non-heat-treated fibers have a denier of 5 or less and said undrawn, non-heat-treated fibers have a denier of more than 3.

4. The non-woven sheet as claimed in claim 1, wherein the content of the sum of said partially drawn, non-heat-treated fibers and said undrawn, non-heat-treated fibers is at least 10% by weight.

5. The non-woven sheet as claimed in claim 1, wherein said air-permeability rate is in the range of from 1 to 5000 sec/100 ml.

6. The non-woven sheet as claimed in claim 5, wherein said air-permeability rate is in the range of from 10 to 5000 sec/100 ml.

7. The non-woven sheet as claimed in claim 1, which sheet allows mercury to penetrate thereinto in an amount of from 0.10 to 0.50 ml/g determined by means of a mercury porosimeter.

8. The non-woven sheet as claimed in claim 1, which sheet is composed of a core layer consisting essentially of at least one type of fibers selected from the group consisting of said partially drawn, non-heat-treated fibers and said undrawn, non-heat-treated fibers and two surface layers each consisting essentially of said drawn, heat-treated fibers.

9. The non-woven sheet as claimed in claim 1, which sheet has a surface roughness, in terms of center line average roughness, of 5 microns or less.

* * * * *